US011731172B2

(12) United States Patent
Qiu et al.

(10) Patent No.: US 11,731,172 B2
(45) Date of Patent: Aug. 22, 2023

(54) SELF-CLEANING AND ANTI-ADHESION APPARATUS FOR MARINE INSTRUMENTS

(71) Applicants: SOUTH CHINA SEA INSTITUTE OF OCEANOLOGY, CHINESE ACADEMY OF SCIENCES, Guangzhou (CN); SOUTHERN MARINE SCIENCE AND ENGINEERING GUANGDONG LABORATORY (GUANGZHOU), Guangzhou (CN)

(72) Inventors: Ning Qiu, Guangzhou (CN); Zhen Sun, Guangzhou (CN)

(73) Assignees: SOUTH CHINA SEA INSTITUTE OF OCEANOLOGY, CHINESE ACADEMY OF SCIENCES, Guangzhou (CN); SOUTHERN MARINE SCIENCE AND ENGINEERING GUANGDONG LABORATORY (GUANGZHOU), Guangzhou (CN)

( * ) Notice: Subject to any disclaimer, the term of this patent is extended or adjusted under 35 U.S.C. 154(b) by 0 days.

(21) Appl. No.: 17/925,614

(22) PCT Filed: Apr. 28, 2022

(86) PCT No.: PCT/CN2022/089698
§ 371 (c)(1),
(2) Date: Nov. 16, 2022

(87) PCT Pub. No.: WO2023/000752
PCT Pub. Date: Jan. 26, 2023

(65) Prior Publication Data

US 2023/0211384 A1 Jul. 6, 2023

(30) Foreign Application Priority Data

Jul. 22, 2021 (CN) ..... 202110830631.6

(51) Int. Cl.
*B08B 1/04* (2006.01)
*B08B 1/00* (2006.01)
*B63B 59/08* (2006.01)

(52) U.S. Cl.
CPC ..... *B08B 1/002* (2013.01); *B08B 1/04* (2013.01); *B08B 2220/01* (2013.01); *B63B 59/08* (2013.01)

(58) Field of Classification Search
CPC ..... B63B 22/00; B63B 22/04; B63B 22/20; B63B 59/08; B08B 1/002; B08B 1/04
See application file for complete search history.

(56) References Cited

U.S. PATENT DOCUMENTS

2018/0291867 A1 10/2018 Cook et al.

FOREIGN PATENT DOCUMENTS

CN 205280172 U 6/2016
CN 208140141 U 11/2018
(Continued)

*Primary Examiner* — Shay Karls
(74) *Attorney, Agent, or Firm* — Bayramoglu Law Offices LLC

(57) ABSTRACT

A self-cleaning and anti-adhesion apparatus for marine instruments includes an installation frame. A first end of the installation frame is fixed with an installation base, and a second end of the installation frame is movable with a screw rod. The upper end of the installation base is movable with a first rotation base. A wire netting ball used for holding a sensor is installed above the first rotation base. The wire netting ball is fixedly connected with the installation base. The top end of the screw rod is fixedly connected with a first end of the flexible connector, and a second end of the flexible connector is fixedly connected with a floating bladder. The screw rod is screwed with an inner wheel of an
(Continued)

internal meshing ratchet mechanism, and an outer wheel of the internal meshing ratchet mechanism is fixed inside the mounting ring.

10 Claims, 3 Drawing Sheets

(56) References Cited

FOREIGN PATENT DOCUMENTS

| | | | | |
|---|---|---|---|---|
| CN | 110243350 | A | | 9/2019 |
| CN | 110813866 | A | | 2/2020 |
| CN | 112879208 | A | | 6/2021 |
| CN | 113086090 | A | | 7/2021 |
| CN | 113414154 | A | * | 9/2021 |
| CN | 113532494 | A | | 10/2021 |
| CN | 114212192 | A | * | 3/2022 |
| JP | 3121912 | U | | 6/2006 |

* cited by examiner

SELF-CLEANING AND ANTI-ADHESION APPARATUS FOR MARINE INSTRUMENTS

CROSS REFERENCE TO THE RELATED APPLICATIONS

This application is the national phase entry of International Application No. PCT/CN2022/089698, filed on Apr. 28, 2022, which is based upon and claims priority to Chinese Patent Application No. 202110830631.6, filed on Jul. 22, 2021, the entire contents of which are incorporated herein by reference.

TECHNICAL FIELD

The present invention involves the field of marine anti-attachment technology, in particular a self-cleaning and anti-adhesion apparatus for marine instruments.

BACKGROUND

Marine observation instruments can be used for sampling, measurement, observation, analysis and data processing and other devices and equipment, including marine physical and. chemical element measurement instruments, marine geological and geomorphological instruments, marine geophysical exploration instruments, marine production nets, etc., thus providing data for marine scientific research, marine ecological environmental protection, marine resources development and utilization, marine disaster forecasting and other fields. Every year, a large number of marine instruments are deployed in many seas around the world, of which a considerable number of marine instruments are deployed on the surface of the sea to perform observation tasks. The surface layer of the ocean is well lit and rich in nutrients, which is particularly suitable for the attachment and growth of the marine environment. When impurities or organisms in the marine environment adhere to the surface of these observation instruments, they will be quickly covered, which will seriously affect the observation accuracy of marine instruments, and even lead to the inability of marine observation instruments to work, and will also reduce the service life of marine observation instruments.

In the prior art, the Chinese utility model patent CN208140141U discloses a kind of anti-marine environment attachment device for marine instruments, which drives the cleaning brush work through the transmission shaft and the fork, sweeps the working surface of the sensor, achieves the purpose of anti-marine environmental adhesion, and protects marine instruments reliably for a long time. However, the technical solution uses mechanical methods and the way of installing protective nets to intercept and sweep the attachments of the marine environment, and the mechanical marine environment attachment and scraping are realized by electric drive in use, which wastes energy.

SUMMARY

In response to the above problems, the present invention proposes a self-cleaning and anti-adhesion apparatus for marine instruments, aiming to solve the problem of energy drive consumption of existing anti-adhesion devices.

To solve the above technical problems, the technical solution of the present invention is as follows:

A self-cleaning and anti-adhesion apparatus for marine instruments is provided and includes mounting brackets, where in one end of the mounting bracket is fixed with a mount; the other end of the mounting bracket is provided with a screw; the upper end of the mounting bracket is provided with a first rotary seat; the first rotating seat is mounted above the wire netting ball for accommodating the sensor; the wire netting ball is fixed to the mount; the tip of the screw is fixed to one of the ends of the flexible connector; the other end of the flexible connector is fixed to the floating bladder; the screw is threaded with the inner wheel of the inner mesh ratchet mechanism; the outer wheel activity of the inner meshing ratchet mechanism is mounted on the inside of the mounting ring; the mounting ring is fixedly connected to the mounting frame; the outer wheel of the inner mesh ratchet mechanism is fixedly connected to the second rotating seat; the first rotating seat and the second rotating seat is provided with a rotating ring; the rotating ring is concentric with the wire netting ball; the inner wall of the rotating ring is provided with a brush; the brush is attached to the outer wall of the wire netting ball.

In some embodiments, the inner wall of the rotating ring is uniformly provided with a first electrode; the wire netting ball away from the side of the first electrode is actively mounted with a second electrode; the first electrode and the second electrode are connected to the positive and negative outputs of the voltage generator, respectively.

In some embodiments, further comprising a feed frame, one end of the feed frame is fixed to the side wall of the first turning seat, the other end of the feed frame is fixedly connected to the second electrode.

In some embodiments, the voltage generator is installed on the side or bottom of the mounting seat.

In some embodiments, further comprising an adjustable spacing of the first slider and a second slider is also included. The fixed end of the first sliding frame instead of the first turning seat and the lower end of the rotating ring is solidified; the sliding end of the first slider is fixed with the first turning seat; the fixed end of the second slider instead of the second rotating seat and the upper end of the rotating ring is fixed; the sliding end of the second slider is fixed with the second rotating seat.

In some embodiments, a C-shaped mounting bracket is installed. The tip of the screw runs through the top of the mounting rack, and the top of the screw is mounted with a limit ring.

In some embodiments, the mounting ring is fixed by mounting the limiting bracket on the outer side.

In some embodiments, the perimeter side of the screw located between the mesh ratchet mechanism and the mounting frame is mounted with a counterweight block.

In some embodiments, the rotating ring is a semi-circular arc, a major arc or a ring-like ring member.

In some embodiments, the flexible connector is a fiber rope.

Beneficial effects of the present invention lies in that: the use of natural ocean wave energy of the buoyancy drive rotating ring unidirectional rotation of the outer wall of the wire netting ball, without other energy, the cleaning process is efficient and reliable, to ensure that the sensor installed inside the wire netting ball is not obscured, improve the observation accuracy of the instrument for a long time span.

Wherein: 1-Mount. Rig, 2-Mounting base, 3-Screw, 4-First Rotary Seat, 5-Wire Netting Ball, 6-Flexible Connector, 7-Floating Bladder, 8-Internal Mesh Ratchet Mechanism, 9-Mounting Ring, 10-Second Rotary Seat, 11-Turning Ring, 12-Brush, 13-First Electrode, 14-Second Electrode, 15-Voltage Generator, 16-Feed Rack, 17-First Slider, 18-Second Slider, 19-Limit Ring, 20-Limit Rack, 21-Counterweight Block, 22-Plug Rod, 23-Spring.

DETAILED DESCRIPTION OF THE EMBODIMENTS

To identify the object, technical package and advantages of the present invention, the contents of the present invention, together with the accompanying drawings and specific embodiments, will be further elaborated. It is understandable that the specific embodiments described herein are only used to explain the present invention and not to qualify the present invention. It should also be noted that, for the sake of description, the drawings show only some, but not all, of the contents associated with the present invention.

Figure 1:
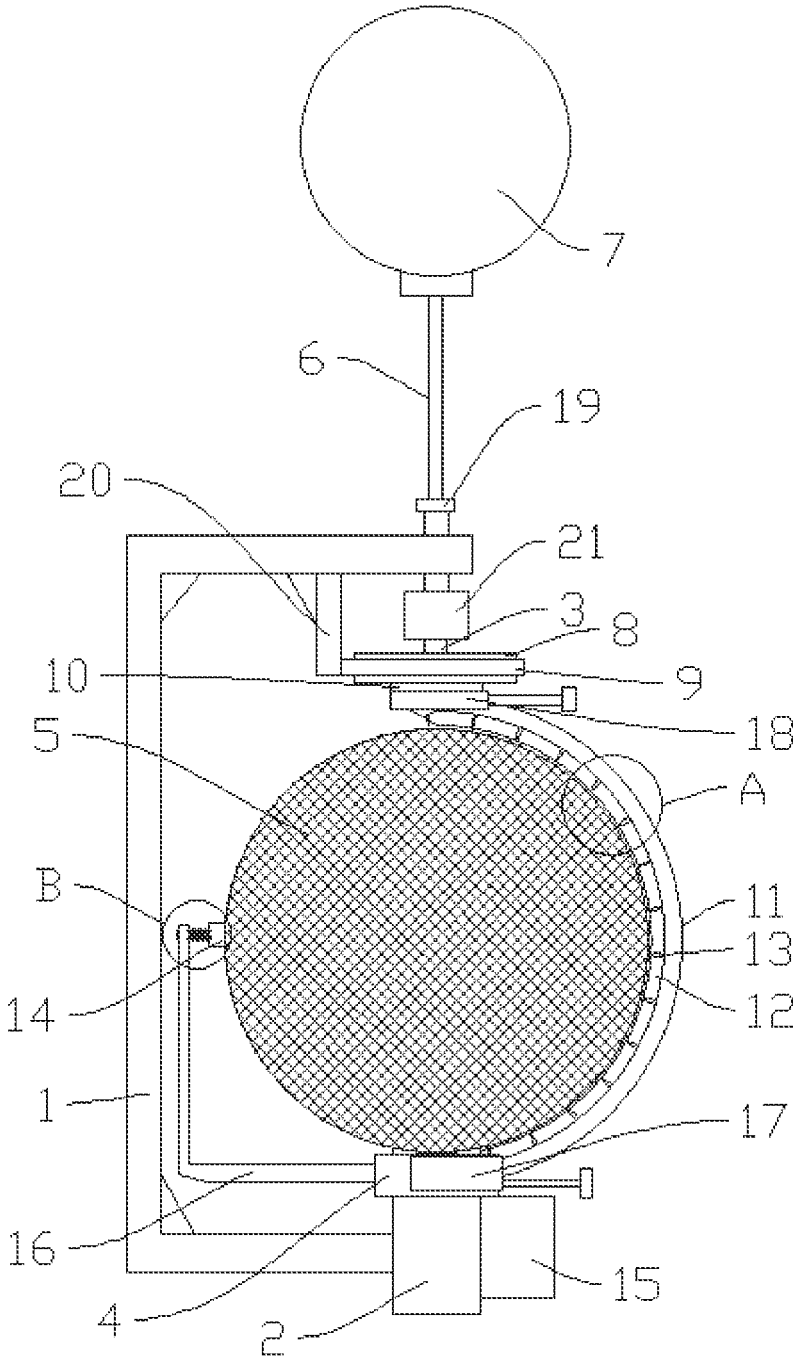
FIG. 1 is a schematic structural diagram of a self-cleaning anti-attachment device for marine instruments disclosed in an embodiment of the present invention.

The present embodiment provides a self-cleaning and anti-adhesion apparatus for marine instruments. As shown in FIG. 1, comprising mounting rack 1 is included, where in one end of the mounting bracket 1 is fixed with mount 2; the other end of the mounting bracket 1 is actively provided with a screw 3; the upper end of the mount 2 is provided with a first rotary seat 4; the top of the first rotating seat 4 is installed with a wire netting ball 5 for accommodating the sensor; the wire netting ball 5 is fixedly connected to the mount 2; the tip of the screw 3 is fixed to one of the ends of the flexible connector 6; the other end of the flexible connector 6 is fixedly connected to the floating bladder 7; the screw 3 is threaded with the inner wheel of the internal mesh ratchet mechanism 8; the outer wheel activity of the inner mesh ratcheting mechanism 8 is mounted on the inside of the mounting ring 9; the mounting ring 9 is fixedly connected to the mounting frame 1; the outer wheel of the inner mesh ratchet mechanism 8 is fixedly connected to the second rotating seat 10; the first rotating seat 4 and the second rotating seat 10 is fixed between the rotating ring 11 which is concentric with the wire netting ball 5; the inner wall of the rotating ring 11 is provided with a brush 12 which is attached to the outer wall of the wire netting ball 5. In the present embodiment, the ascending linear motion of the lead screw 3 can drive the internal meshing ratchet mechanism 8 inner wheel of the pawl into the internal mesh ratcheting mechanism 8 outer wheel togging, realizing one-way power transmission.

In the present embodiment, when the self-cleaning anti-attachment device is working normally, the floating bladder 7 is exposed to the sea surface by its own buoyancy. With the natural floating of the sea surface, the floating bladder 7 follows the floating on the sea surface, but due to inertia, other components other than the floating bladder 7 remain in the original position, so the floating bladder 7 upward linear motion is straightened flexible connector 6. And then the flexible connector 6 transmits this linear motion to the screw 3 to form a rotary motion. At this time, the internal meshing ratchet mechanism 8 transmits the rotation movement of the screw 3 to the rotating ring 11, the rotating ring 11 conducts a one-way rotation around the wire netting ball 5 or even several laps, and finally the brush 12 is provided on the inner wall of the rotating ring 11 to sweep away the attachments on the surface of the wire netting ball 5. On the contrary, the sea surface changes with the gravity. Due to the inertia, the floating bladder 7 and other components will sink together, leaving the flexible connector 6 be slightly relaxed, plus the inner mesh ratchet mechanism 8 one-way motion design protection, when the inner wheel rotates in the opposite direction, the inner wheel of the ratchet on the back of the ratchet tooth slid over, the outer wheel is stationary can not transmit power, to avoid turning ring 11 in a small range of back and forth, the cleaning of the wire netting ball 5 is not in place. A self-cleaning and anti-adhesion device disclosed in the present embodiment uses the buoyancy of the natural wave energy to drive the rotating ring 11 unidirectional rotation to clean the outer wall of the wire netting ball 5, without other energy, the cleaning process is efficient and reliable, to ensure that the sensor (such as the temperature salt depth probe) installed inside the wire netting ball 5 is not blocked, and the observation accuracy of the instrument for a long time span is improved.

Figure 2:
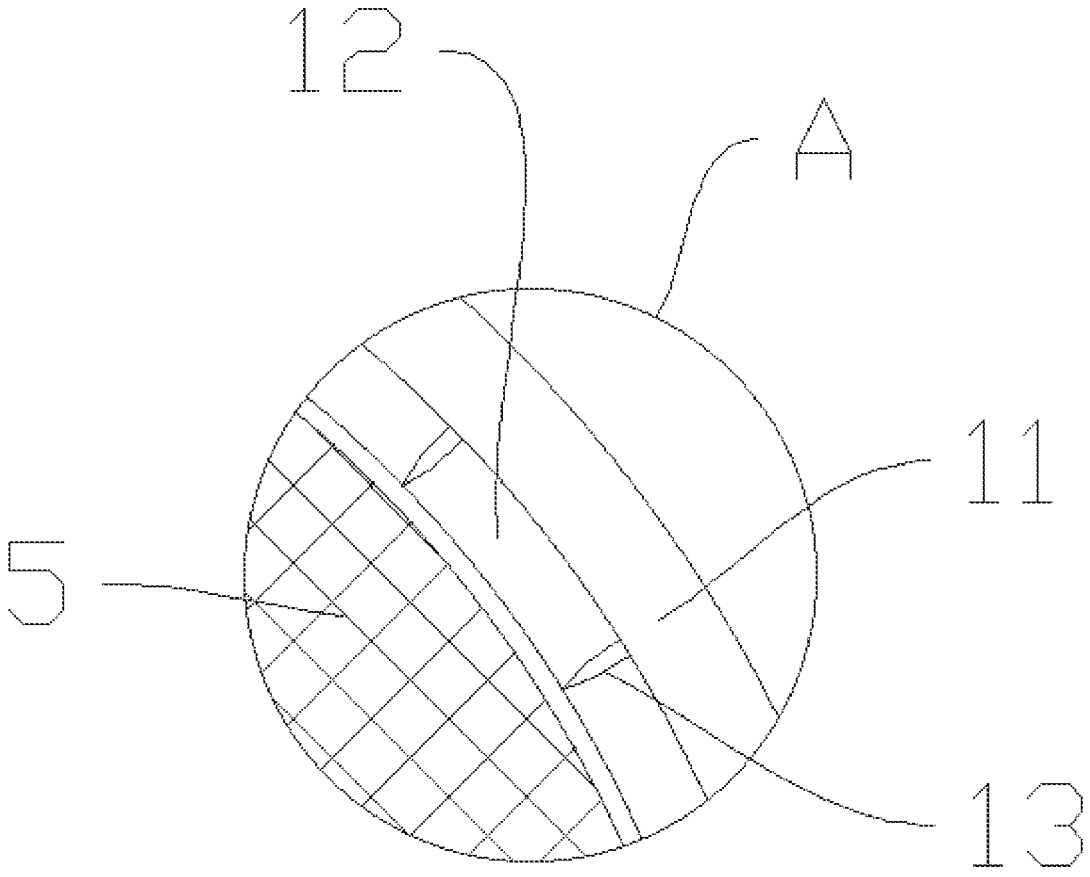
FIG. 2 is a local enlarged plot of FIG. 1 along the A line.

In an alternative embodiment, as shown in FIG. 2, the inner wall of the above-described rotating ring 11 is uniformly provided with a first electrode 13, the wire netting ball 5 is actively mounted on the side away from the first electrode 13, the second electrode 14 is installed, the first electrode 13 and the second electrode 14 are connected to the positive and negative outputs of the voltage generator 15, respectively. Voltage generator 15 may be timed after a terminal time to release a certain amount of voltage for a certain length of 20 min, and then periodically the marine environmental attachment of the wire netting ball 5 is expelled or inactivated under the action of an electric current, the inactivated marine environmental attachment due to the inability to produce new adhesion chemicals, and then the adhesion is reduced, easy to peel off under the action of a brush.

A feed frame 16 is also included. One end of the feed frame 16 is fixedly connected to the side wall of the first turntable 4, the other end of the feed frame 16 is fixedly connected to the second electrode 14, in fact, in the above scheme, the wire netting ball 5 and the mount 2 is fixed, so the wire netting ball 5 is always protected relatively fixed in normal operation, the action end is the rotating ring 11 and the power supply frame 16, respectively, the first electrode 13 and the second electrode 14 are installed on the rotating ring 11 and the power supply frame 16 for one-way rotation.

Figure 3:
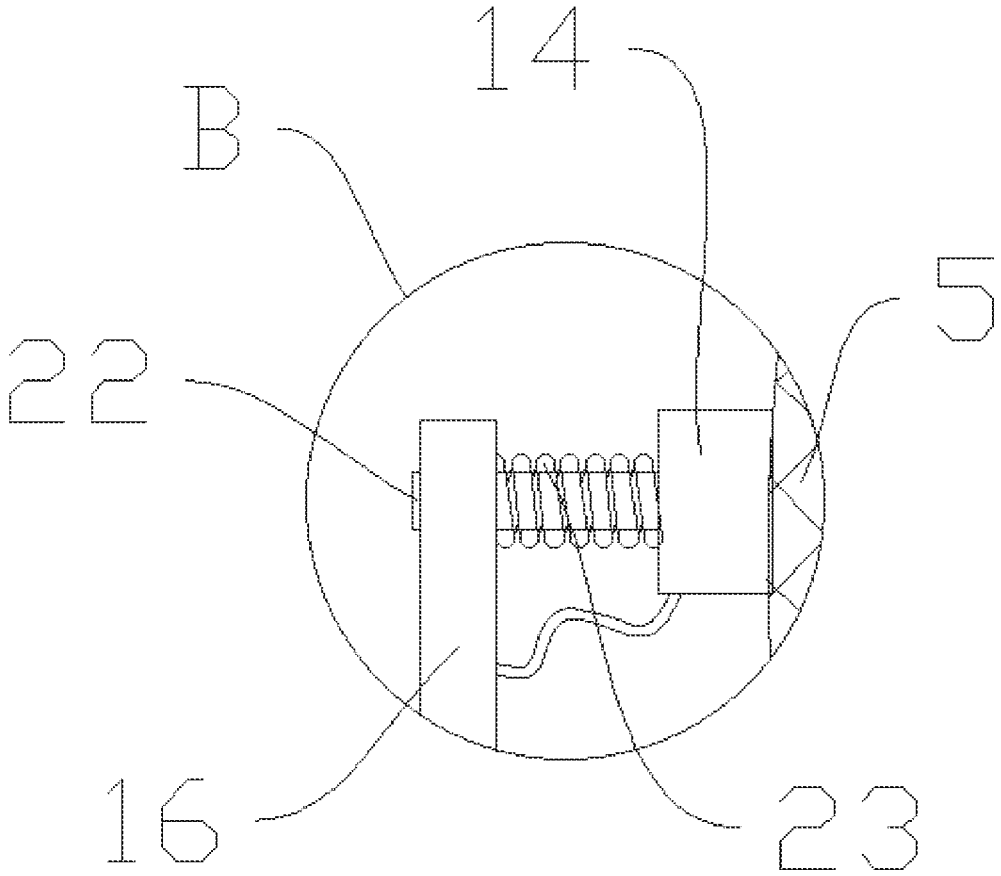
FIG. 3 shows a local enlarged plot of FIG. 1 along the B-line range.

As shown in FIG. 3, the second electrode 14 is actively connected to the feed frame 16 by the plug rod 22, the plug rod 22 is sheathed to the spring 23, and the second electrode 14 is automatically pressed to the wire netting ball 5 by the elastic force of the spring 23. Preferably, the second electrode 14 is a carbon brush, the voltage generator 15 is mounted on the side or bottom of the mounting seat 2.

An adjustable spacing of the first sliding frame 17 and a second slider 18 are also included. The fixed end of the first sliding frame 17 instead of the first turning seat 4 and the lower end of the rotating ring 11 for consolidation, the sliding end of the first sliding frame 17 and the first rotating seat 4 for solid connection, the fixed end of the second sliding frame 18 instead of the second rotating seat 10 and the upper end of the rotating ring 11 for solid connection, the sliding end of the second sliding frame 18 and the second rotating seat 10 for solid connection. The first slider 17 and the second slider 18 are screw limiters, mainly used to adjust the distance between the rotating ring 11 and the wire netting ball 5, to achieve close contact between the brush 12 and the wire netting ball 5, the principle is to use a screw to control the distance between the fixed end and the sliding end.

In some alternative embodiments, the mounting bracket 1 is a C shape, the tip of the screw 3 runs through the top of the mounting rack 1, and the top of the screw 3 is mounted with a limit ring 19, the limit ring 19 may be directly connected to the flexible connector 6.

In some optional embodiments, since the mounting ring 9 must maintain its fixed attitude, therefore, the mounting ring 9 by the outer side of the installation of the limit frame 20 and the mounting frame 1 fixed connection, as can be seen in the figure, the limit frame 20 may be any shape of the connector, can be fixed to the mounting ring 1 at one of the ends of the lower, with the screw 3, the internal mesh ratcheting mechanism 8 and other mechanism coaxial settings, in order to form an effective power transmission.

In some alternative embodiments, the screw 3 perimeter side located between the internal mesh ratchet mechanism 8 and the mounting frame 1 is installed with a counterweight block 21, when the tide, waves, surges or other disturbance factors caused by the sea surface fluctuations when the sea surface sinks, the counterweight block 21 due to its own gravity action downward motion, while the traction screw 3 moves downwards, and finally the screw 3 is reset under the limit action of the limit ring 19, this process, the internal mesh ratchet mechanism 8 is equivalent to reversal, no power is transmitted to the rotating ring 11, Thus the rotating ring 11 does not perform a rotational motion.

In some alternative embodiments, the rotating ring 11 is a semi-circular arc, a superior arc or a toroidal ring member.

In some alternative embodiments, the flexible connector 6 is a fiber rope.

The above embodiments are only to illustrate the technical conception and features of the present invention, the object of which is to enable those of ordinary skill in the art to understand the contents of the present invention and implement it accordingly, and not to limit the scope of protection of the present invention. All equivalent changes or modifications made according to the substance of the contents of the present invention should be covered within the scope of the invention.

What is claimed is:

1. A self-cleaning and anti-adhesion apparatus for marine instruments, comprising an installation frame, wherein one end of the installation frame is fixed with an installation seat; the other end of the installation frame is movable with a screw; an upper end of the installation seat is movable with a first rotating seat; a top of the first rotating seat is fixed with a wire netting ball used to accommodate a sensor; the wire netting ball is fixed. with the installation seat; a top of the screw is fixed with one end of a flexible connector; the other end of the flexible connector is fixed with a floating bladder; and the screw is screwed with an inner wheel of an internal meshing ratchet mechanism; an outer wheel of the internal meshing ratchet mechanism is installed inside a mounting ring; the mounting ring is fixedly connected with the installation frame; the outer wheel of the internal meshing ratchet mechanism is fixedly connected with a second rotating seat; rotating ring is provided between the first rotating seat and the second rotating seat; the rotating ring is concentric with the wire netting ball; an inner wall of the rotating ring is equipped with a brush; the brush is attached to an outer wall of the wire netting ball.

2. The self-cleaning and anti-adhesion apparatus for the marine instruments of claim 1, wherein a first electrode is uniform installed on the inner wall of the rotating ring, a second electrode is movably installed on a side of the wire netting ball away from the first electrode, and the first electrode and the second electrode are connected with positive and negative output ends of a voltage generator, respectively.

3. The self-cleaning and anti-adhesion apparatus for the marine instruments of claim 2, further comprising a power supply rack, wherein one end of the power supply rack is fixedly connected with a side wall of the first rotating seat, and the other end of the power supply rack is fixedly connected with the second electrode.

4. The self-cleaning and anti-adhesion apparatus for the marine instruments of claim 2, wherein the voltage generator is installed on a side or a bottom of the mounting seat.

5. The self-cleaning and anti-adhesion apparatus for the marine instruments of claim 1, further comprising a first sliding frame and a second sliding frame with adjustable spacing, wherein a fixed end of the first sliding frame is fixed in place of the first rotating seat and a lower end of the rotating ring, a sliding end of the first sliding frame is fixed in place of the first rotating seat, a fixed. end of the second sliding frame is fixed in place of the second rotating seat and an upper end of the rotating ring, and a sliding end of the second sliding frame is fixed in place of the second rotating seat.

6. The self-cleaning and anti-adhesion apparatus for the marine instruments of claim 1, wherein the installation frame is C-shaped, the top of the screw runs through a top of the installation frame, and the top of the screw is mounted with a limit ring.

7. The self-cleaning and anti-adhesion apparatus for the marine instruments of claim 1, wherein the mounting ring and the installation frame are fixedly connected by installing a limiter on an outer side.

8. The self-cleaning and anti-adhesion apparatus for the marine instruments of claim 1, wherein counterweight blocks are installed around the screw between the internal meshing ratchet mechanism and the mounting frame.

9. The self-cleaning and anti-adhesion apparatus for the marine instruments of claim 1, wherein the rotating ring is a semi-arc ring, an arc ring or a circular ring.

10. The self-cleaning and anti-adhesion apparatus for the marine instruments of claim 1, wherein the flexible connector is a fiber rope.

* * * * *